US007878829B2

(12) United States Patent
Yang et al.

(10) Patent No.: US 7,878,829 B2
(45) Date of Patent: Feb. 1, 2011

(54) FLOATABLE ELECTRICAL CONNECTOR ASSEMBLY

(75) Inventors: Sheng-Ho Yang, Tu-Cheng (TW); Chun-Chieh Yang, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/549,580

(22) Filed: Aug. 28, 2009

(65) Prior Publication Data

US 2010/0062659 A1 Mar. 11, 2010

(30) Foreign Application Priority Data

Sep. 8, 2008 (TW) ..... 097216190
Sep. 8, 2008 (TW) ..... 097216191

(51) Int. Cl.
*H01R 13/64* (2006.01)

(52) U.S. Cl. ..... 439/247

(58) Field of Classification Search ..... 439/752, 439/83, 78, 562, 566, 733.1, 247, 248
See application file for complete search history.

(56) References Cited

U.S. PATENT DOCUMENTS 6,019,213 A * 2/2000 Schubert ..... 198/419.3
6,743,053 B2 * 6/2004 Wu ..... 439/634
7,186,126 B2 * 3/2007 Umehara et al. ..... 439/247
7,467,969 B2 * 12/2008 Liu et al. ..... 439/493
7,753,736 B2 * 7/2010 Yang et al. ..... 439/638
2004/0029428 A1 * 2/2004 Wu ..... 439/357
2009/0246990 A1 * 10/2009 Yang et al. ..... 439/135
2010/0035447 A1 * 2/2010 Chen et al. ..... 439/73
2010/0120283 A1 * 5/2010 Yang et al. ..... 439/357
2010/0173533 A1 * 7/2010 Yang et al. ..... 439/733.1

* cited by examiner

*Primary Examiner*—Neil Abrams
*Assistant Examiner*—Phuong Nguyen
(74) *Attorney, Agent, or Firm*—Wei Te Chung; Andrew C. Cheng; Ming Chieh Chang

(57) ABSTRACT

A floatable electrical connector assembly comprises a fixed housing (10) defining a front receiving frame (112) having an edge section (113). A movable housing (20) is discretely and movably attached to the fixed housing (10) in an up-to-down direction and adapted to be rested on the edge section of the receiving frame. One of the movable housing and the fixed housing defines a mating bar (217) while the other one of the movable housing and the fixed housing has a receiving slot (119) defining an enclosed boundary for receipt of the mating bar so as to permit the movable housing stably movable relative to the fixed housing in the up-to-down direction.

19 Claims, 15 Drawing Sheets

FLOATABLE ELECTRICAL CONNECTOR ASSEMBLY

BACKGROUND OF THE INVENTION

1. Field of the Invention

The present invention relates to the art of electrical connectors, and more particularly to a floatable electrical connector assembly having a fixed housing and a movable housing discretely and movably attached to the fixed housing for permitting the movable housing movable relative to the fixed housing.

2. Description of the Related Art

In the case where, for example, a relatively small-sized hard disc drive conformity with the SATA (Serial AT Attachment) which is one of extensions of the ATA (AT Attachment) standard is electrically connected with a solid printed circuit board, on which various electrical parts are directly mounted, an electrical connector having a floating coupling portion which is able to move in a predetermined range to be coupled with the hard disc drive is used. The electrical connector having the floating coupling portion comprises a fixed housing attached to the solid printed circuit board and a movable housing coupled through conductive contacts with the fixed housing. A connecting hollow in which a counterpart electrical connector provided on the hard disc drive is inserted to be connected with the conductive contacts is provided in the movable housing to form the floating coupling portion with which the hard disc drive is coupled.

In such an electrical connector as mentioned above, vibrations and shocks acting on the hard disc drive coupled with the floating coupling portion are absorbed by the movable housing in which the floating coupling portion is provided. Therefore, the hard disc drive coupled with the floating coupling portion is protected against the vibrations and shocks acting thereon.

There has been previously proposed, as the electrical connector having the floating coupling portion, an electrical connector in which a movable housing provided with a coupling hollow forming a floating coupling portion is arranged to be able to move to a fixed housing attached to a circuit board in a predetermined range. But the movable housings of these connectors are not capable of being stably movable relative to the fixed housing due to their floating coupling portions.

SUMMARY OF THE INVENTION

An object of the present invention is to provide a floatable electrical connector assembly having a fixed housing and a movable housing discretely and movably attached to the fixed housing for permitting the movable housing stably movable relative to the fixed housing in an up-to-down direction.

A floatable electrical connector assembly according to an embodiment of the present invention comprises a fixed housing made of an insulative material, the fixed housing defining a front receiving frame, the receiving frame having an edge section. A movable housing, made of an insulative material, is discretely and movably attached to the fixed housing in an up-to-down direction and adapted to be rested on said edge section of the receiving frame. The movable housing defines an interior mating face and a back wall. A plurality of contact terminals is assembled to the movable housing, each of the contact terminals having an engaging section exposed on said mating face, a solder tail exposed out of said back wall, and an S-shaped flexible connecting section connected between said engaging section and said solder tail. One of the movable housing and the fixed housing defines a mating bar adjacent said back wall while the other one of the movable housing and the fixed housing has a receiving slot defining an enclosed boundary for receipt of the mating bar so as to allow the movable housing movable relative to the fixed housing in the up-to-down direction mainly be means of cooperation of the mating bar and the receiving slot. This arrangement assures the movable housing stably movable relative to the fixed housing by means of cooperation of the mating bar and the receiving slot. The mating bar is confined by the enclosed boundary of the receiving slot to provide the stable movement therebetween.

A floatable electrical connector assembly according to another embodiment of the present invention comprises an insulative fixed housing having a front receiving frame, the receiving frame defined by a pair of sidewalls and a bottom wall extending fully between the pair of sidewalls. An insulative movable housing is discretely and movably attached to the fixed housing in an up-to-down direction and adapted to be rested on the edge section of the receiving frame, the movable housing defining an interior mating face and a back wall. A plurality of contact terminals is assembled to the movable housing, each of the contact terminals having an engaging section exposed on said mating face, a solder tail exposed out of the back wall, and an S-shaped flexible connecting section connected between the engaging section and the solder tail. The fixed housing has a mating bar extending from the bottom wall of the receiving frame, and the movable housing has a receiving slot for receipt of the mating bar so as to allow the movable housing movable relative to the fixed housing in the up-to-down direction mainly be means of cooperation of the mating bar and the receiving slot. This arrangement assures the movable housing stably movable relative to the fixed housing by means of cooperation of the mating bar and the receiving slot.

Other features and advantages of the present invention will become more apparent to those skilled in the art upon examination of the following drawings and detailed description of preferred embodiments, in which:

DETAILED DESCRIPTION OF PREFERRED EMBODIMENT

Figure 1:
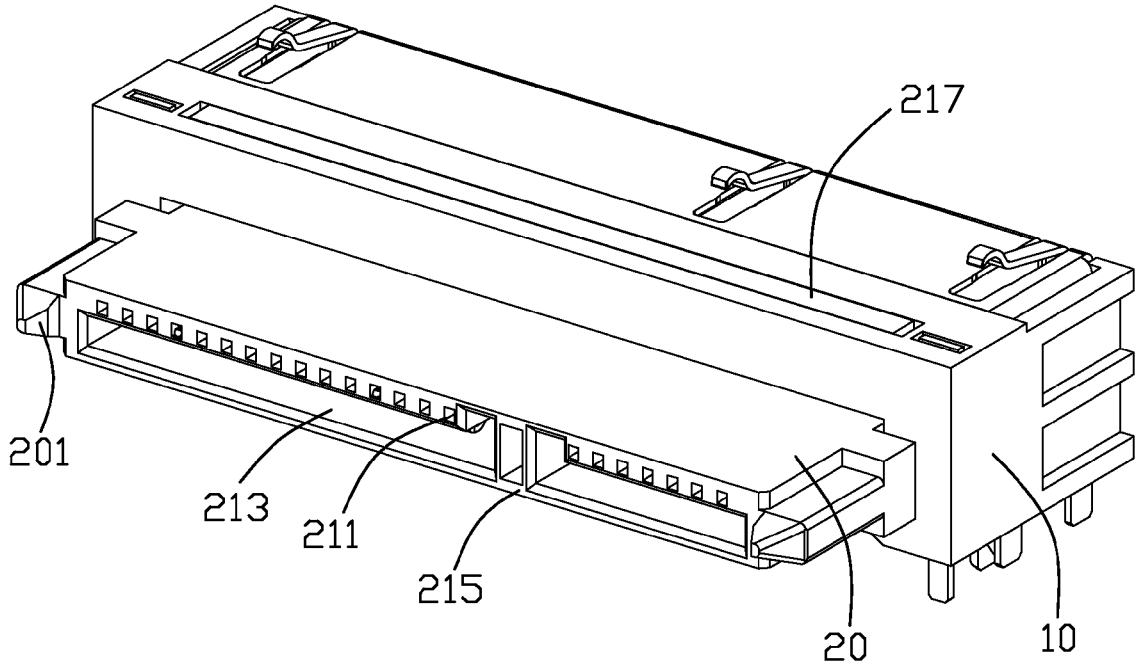
FIG. 1 is an assembled, perspective view of a floatable electrical connector assembly according to a first embodiment of the present invention.
Figure 2:
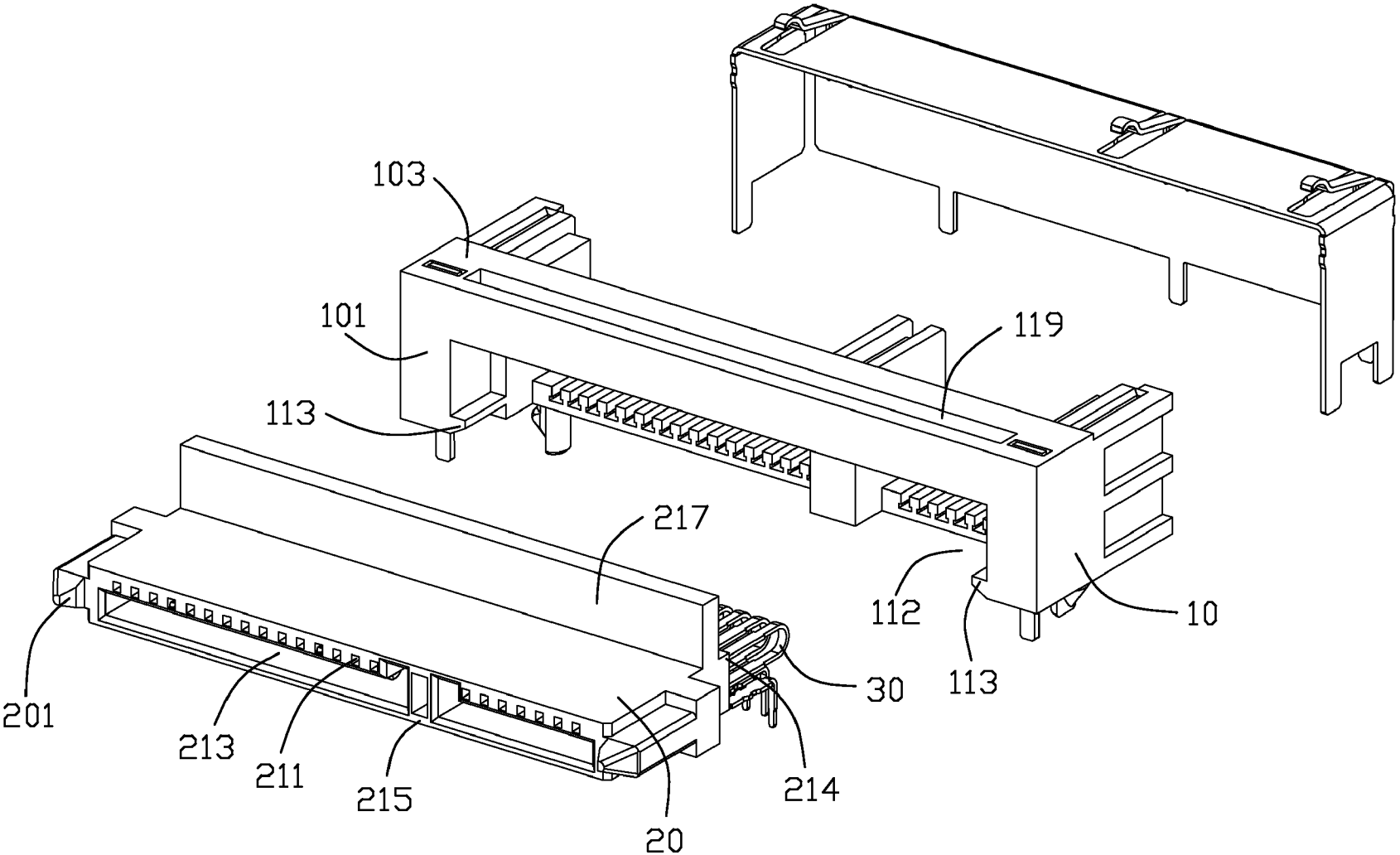
FIG. 2 is an exploded, perspective view of the electrical connector assembly of FIG. 1.

Referring to FIGS. 1 to 6, a floatable electrical connector assembly according to a first embodiment of the present invention is shown to include a fixed housing 10 and a movable housing 20 discretely and movably attached to the fixed housing 10 in an up-to-down direction. Both of the fixed housing 10 and the movable housing 20 are made of an insulative material. The fixed housing 10 defines a front hollow receiving frame 112, which has an edge section 113 for the movable housing 20 to be rested thereon. The hollow receiving frame 112 defines an inner frame boarder in cooperation with the outer frame border of the fixed housing 10 for receipt of the fixed housing 10 so as to permit the movable housing 20 movable relative to the fixed housing 10 in a predetermined height in the up-to-down direction. The receiving frame 112, on a lower section of a front face 101 of the fixed housing 10 but not on an upper section of the front face 101, has the predetermined height defined by an upper edge and the edge section 113, which has a cutout in a middle of a bottom edge of the receiving frame 112. The fixed housing 10 includes a receiving slot 119 with an enclosed boundary on thereof a top face 103 proximate to the front face 101 of the fixed housing 10 to be in communication with the receiving frame 112 on the lower section of the front face 101.

The movable housing 20 includes a forwardly protruding mating port extending from a back wall 214 and divided into a long section and a short section by a partition wall 215. Each of the long section and the short section has a cavity 213 and a plurality of passageways 211 in communication with the cavity 213, and defines an interior mating face. In this embodiment, the movable housing 20 includes a mating bar 217 adjacent the back wall 214 for insertion into the receiving slot 119 of the fixed housing 10 so as to allow the movable housing 20 movable relative to the fixed housing 10 in the up-to-down direction mainly by means of cooperation of the mating bar 217 and the receiving slot 119. A pair of positioning posts 201 is formed on opposite outmost sides of the mating port, each post 201 defining an outmost edge and an inner edge on a corresponding outmost side of the mating port. The mating bar 217 extends fully between the opposite inner edges of the pair of positioning posts 201. This arrangement assures the movable housing 20 stably movable relative to the fixed housing 10 by means of cooperation of the mating bar 217 and the receiving slot 119. The mating bar 217 is confined by the enclosed boundary of the receiving slot 119, and the mating bar occupies a large area to provide the stable movement therebetween.

Figure 3:
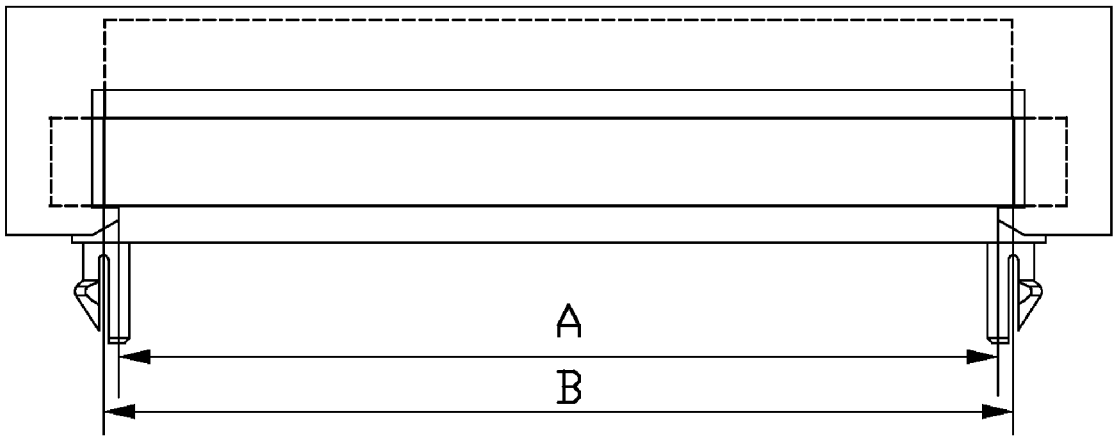
FIG. 3 is a front view of the electrical connector assembly of FIG. 1.
Figure 4:
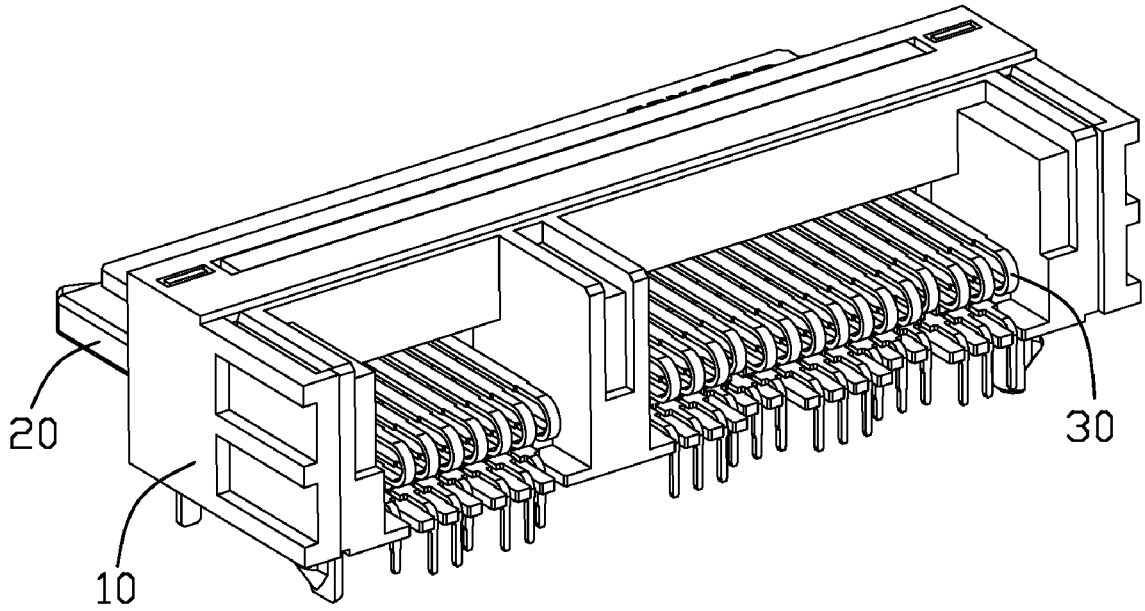
FIG. 4 is another assembled, perspective view of the electrical connector assembly of FIG. 1, viewed from another aspect.
Figure 5:
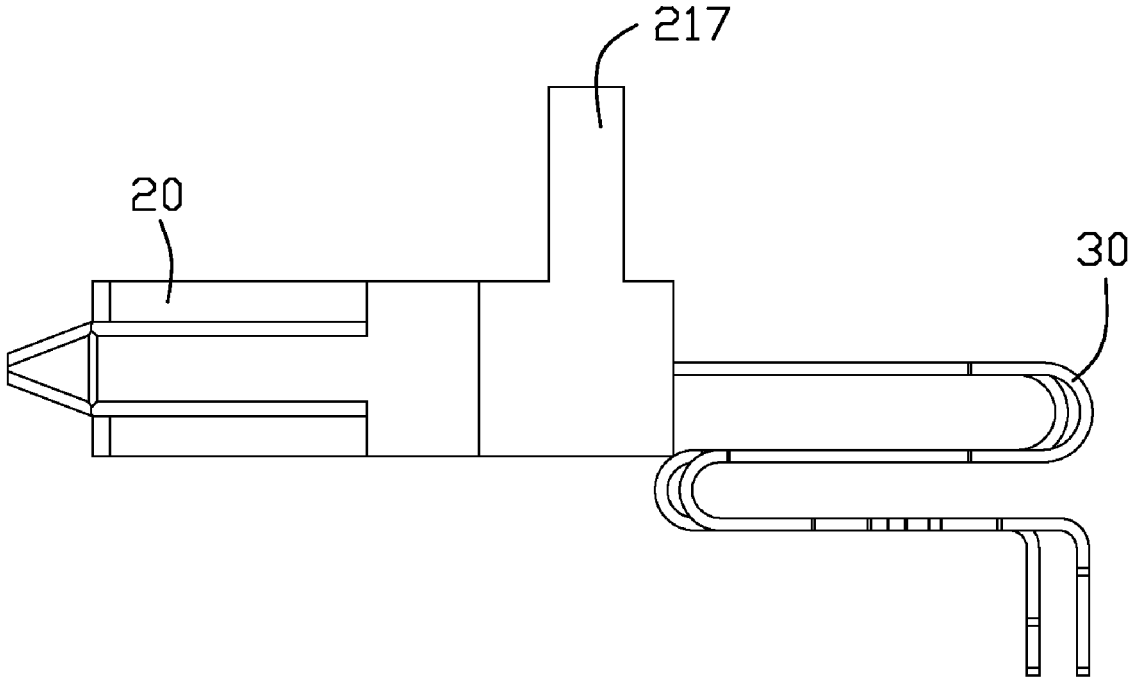
FIG. 5 is a side view of the electrical connector assembly of FIG. 4.
Figure 6:
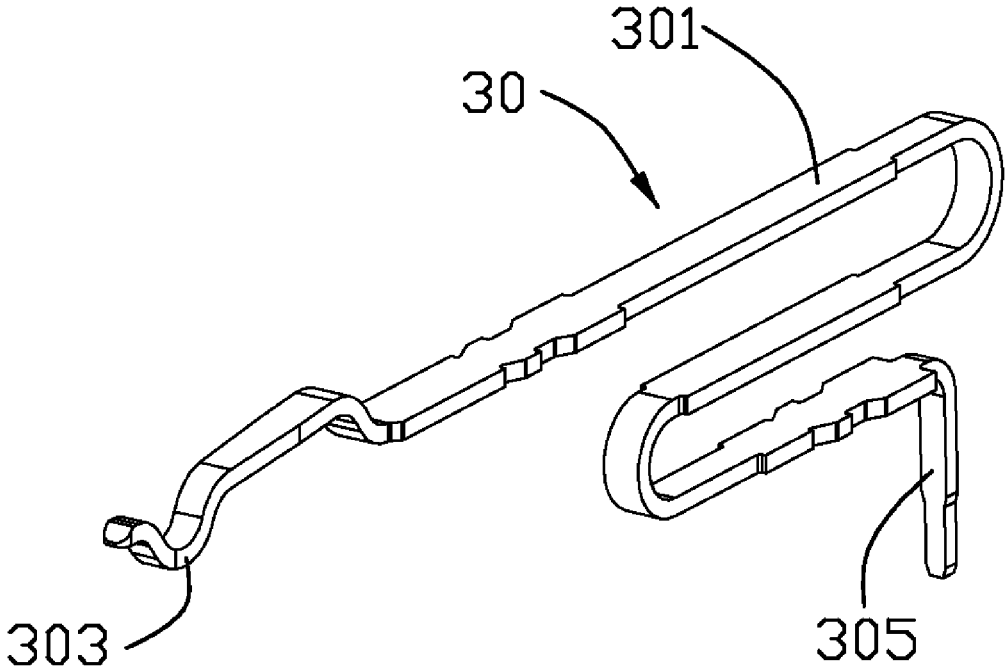
FIG. 6 is a perspective view of a contact terminal of the electrical connector assembly of FIG. 4.

A plurality of contact terminals 30 are assembled to the movable housing 20. Each of the contact terminals 30 has an engaging section 303 exposed on the mating face, a solder tail 305 exposed out of the back wall 214, and an S-shaped flexible connecting section 301 connected between the engaging section 303 and the solder tail 305 for allowing the movable housing 20 movable relative to the fixed housing 10. FIG. 3 is a front view showing the movable housing 20 assembled onto the fixed housing 10 and rested on the fixed housing 10. The front receiving frame 112 has a distance A, defined by ends of the cutout adjacent to the edge section 113, less than a distance B of a bottom section of the movable housing 20 to let the movable housing 20 slantedly assembled to the fixed housing 10, thereby preventing the movable housing 20 from being dropped out of the fixed housing 10.

Figure 7:
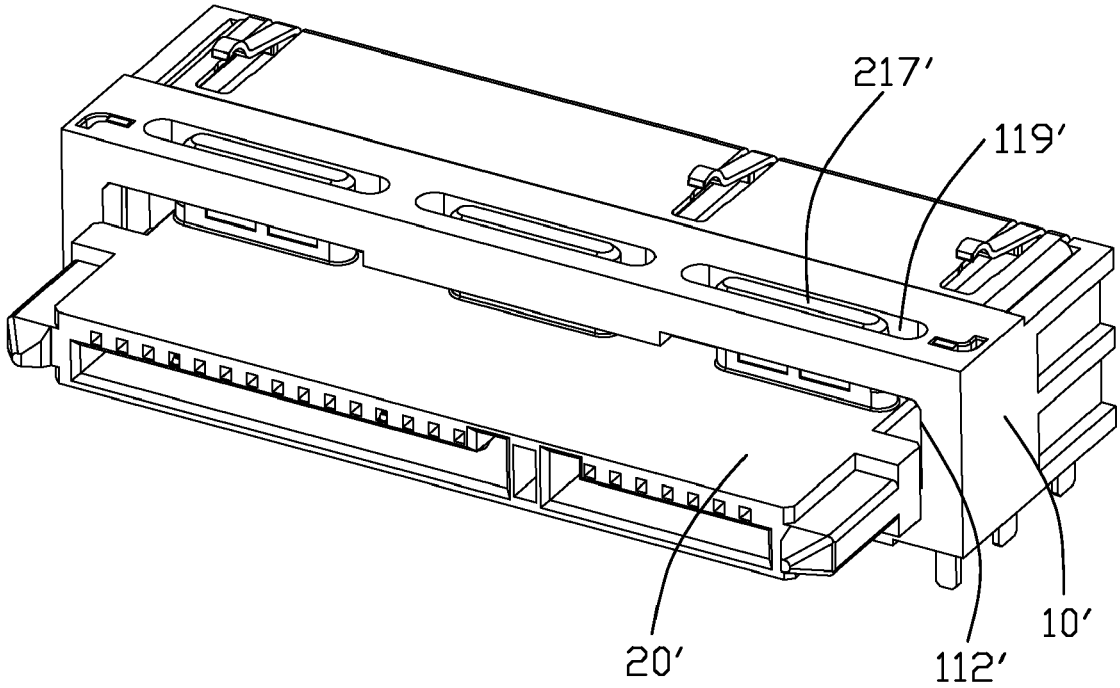
FIG. 7 is an assembled, perspective view of a floatable electrical connector assembly according to a second embodiment of the present invention.
Figure 8:
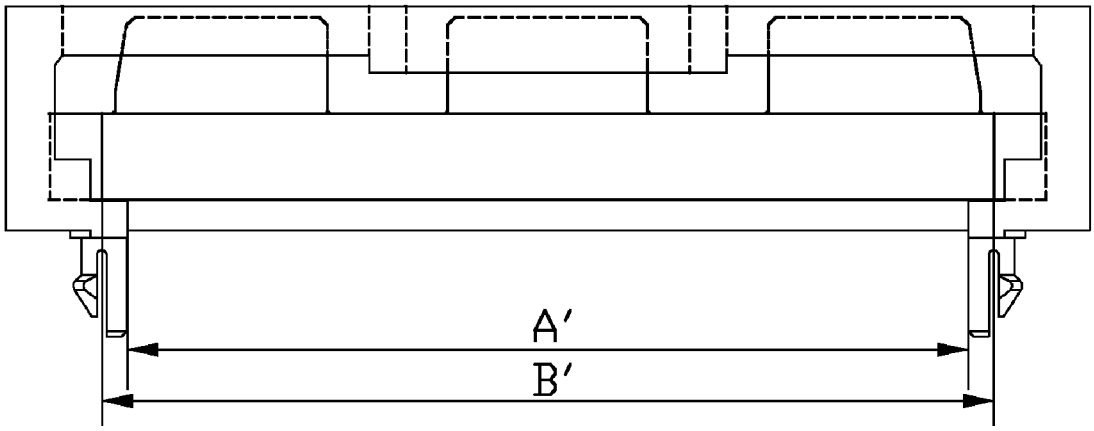
FIG. 8 is front view of an electrical connector assembly of FIG. 7.
Figure 9:
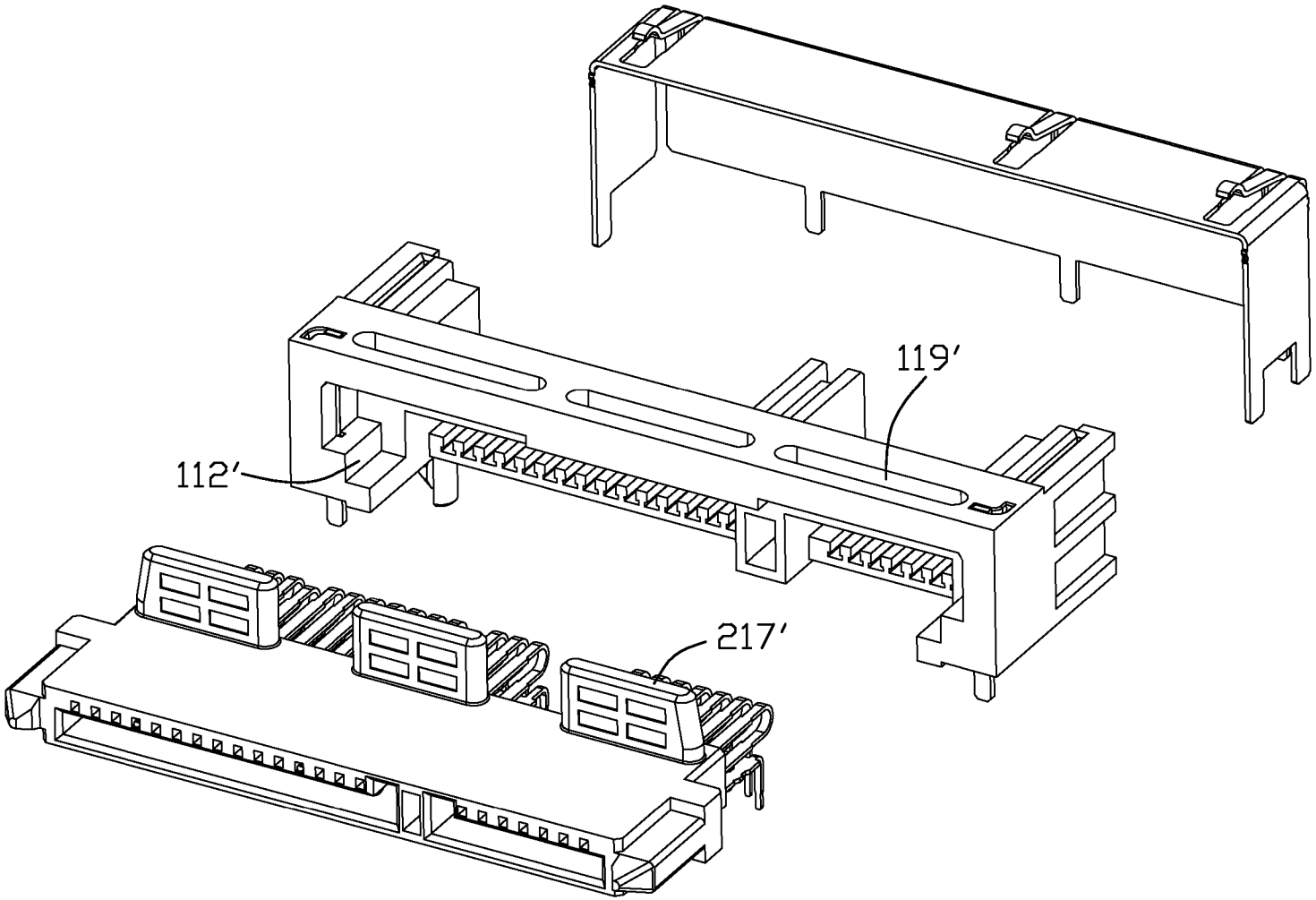
FIG. 9 is an exploded, perspective view of the electrical connector assembly of FIG. 7.
Figure 10:
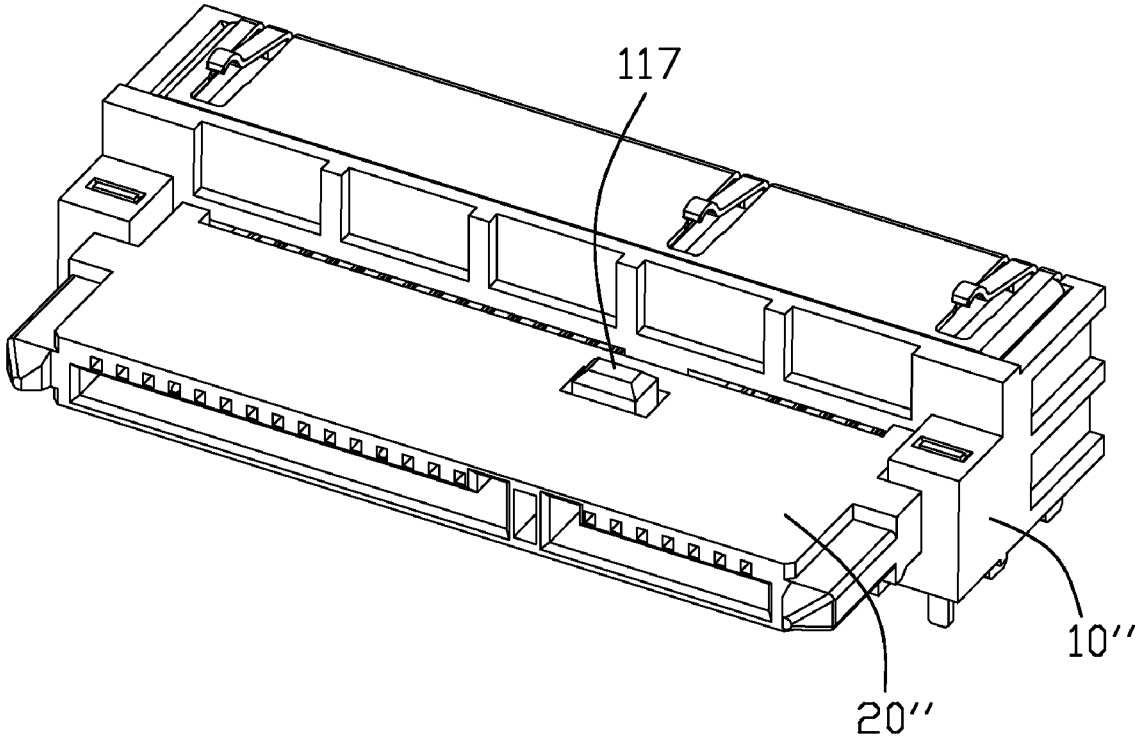
FIG. 10 is an assembled, perspective view of a floatable electrical connector assembly according to a third embodiment of the present invention.
Figure 11:
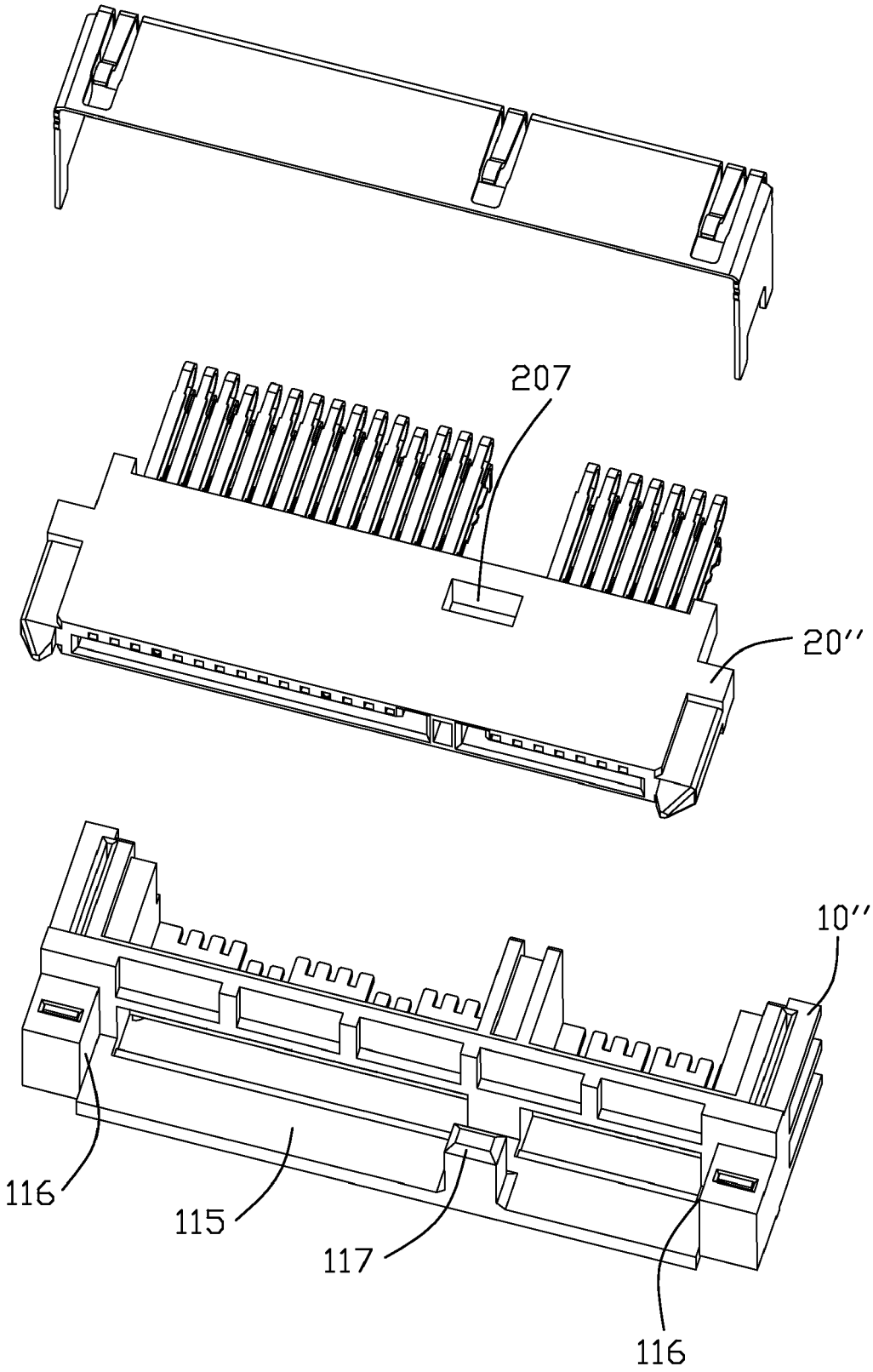
FIG. 11 is an exploded, perspective view of the electrical connector assembly of FIG. 10.
Figure 12:
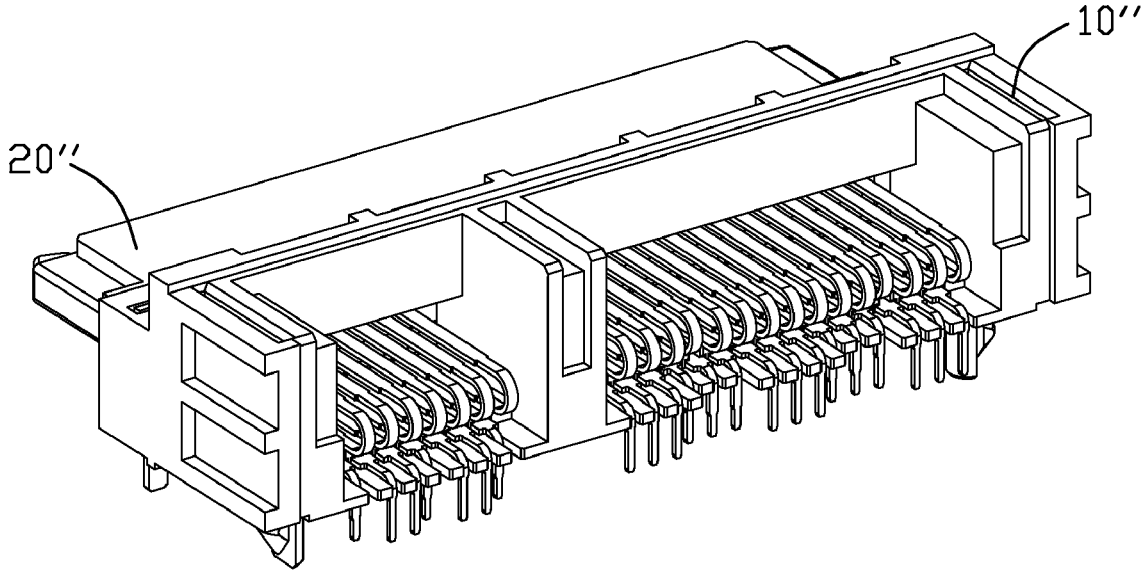
FIG. 12 is another assembled, perspective view of the electrical connector assembly of FIG. 10, viewed from another aspect.
Figure 13:
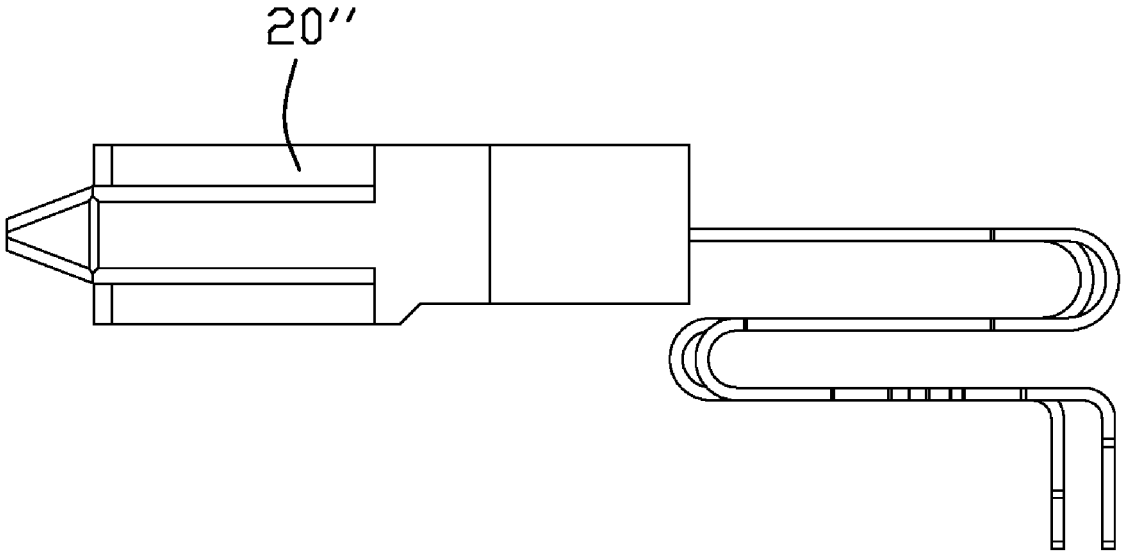
FIG. 13 is a side view of the electrical connector assembly of FIG. 12.

Referring to FIGS. 7 to 9, a floatable electrical connector assembly according to a second embodiment of the present invention is the same to the floatable electrical connector assembly of the first embodiment except that the fixed housing 10' is provided with three of the receiving slots 119' each defining an enclosed boundary, and the movable housing 20' is provided with three of the mating bars 217' in correspondence with the receiving slots 119'. This arrangement assures the movable housing 20' stably movable relative to the fixed housing 10' by means of cooperation of the mating bar 217' and the receiving slot 119'. Each of the mating bar 217' is confined by the enclosed boundary of a corresponding receiving slot 119', and three of the mating bars occupy a large area to provide the stable movement therebetween. FIG. 8 is a front view showing the movable housing 20' assembled onto the fixed housing 10' and rested on the fixed housing 10'. The front receiving frame 112' has a distance A', defined by ends of the cutout, less than a distance B' of a bottom section of the movable housing 20' to let the movable housing 10' slantedly assembled to the fixed housing 10', thereby preventing the movable housing 20' from being dropped out of the fixed housing 10'.

Referring to FIGS. 10 to 13, a floatable electrical connector assembly according to a third embodiment of the present invention is shown. The floatable electrical connector assembly of the third embodiment is the same to the floatable electrical connector assembly of the first embodiment except that the fixed housing 10" has the mating bar 117 while the movable housing 20" has the receiving slot 207 for receipt of the mating bar 117 so as to allow the movable housing 20" movable relative to the fixed housing 10" in the up-to-down direction mainly by means of cooperation of the mating bar 117 and the receiving slot 207. This arrangement assures the movable housing 20" stably movable relative to the fixed housing 10" by means of cooperation of the mating bar 117 and the receiving slot 207. The mating bar 117 is confined by the enclosed boundary of the receiving slot 207 to provide the stable movement therebetween. In this embodiment, the fixed housing 10" has the front receiving frame defined by a pair of sidewalls 116 and a bottom wall 115 extending fully between the pair of sidewalls 116. The mating bar 117 is configured to extend from the bottom wall 115 of the receiving frame. The receiving slot 207 has an enclosed boundary.

Figure 14:
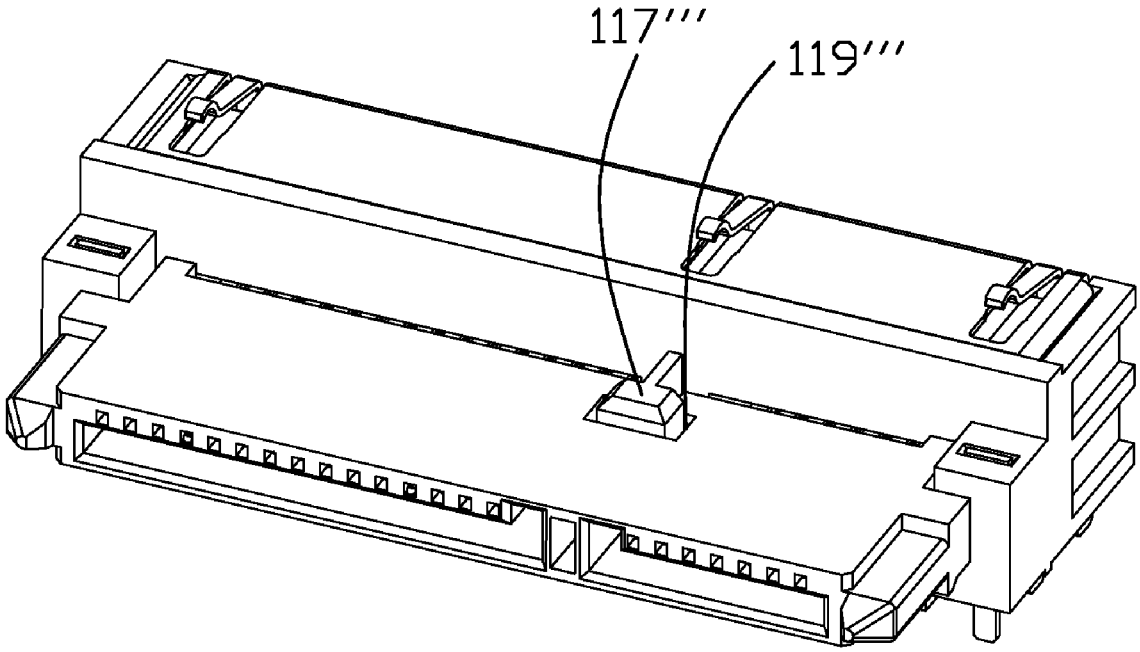
FIG. 14 is an assembled, perspective view of a floatable electrical connector assembly according to a fourth embodiment of the present invention.
Figure 15:
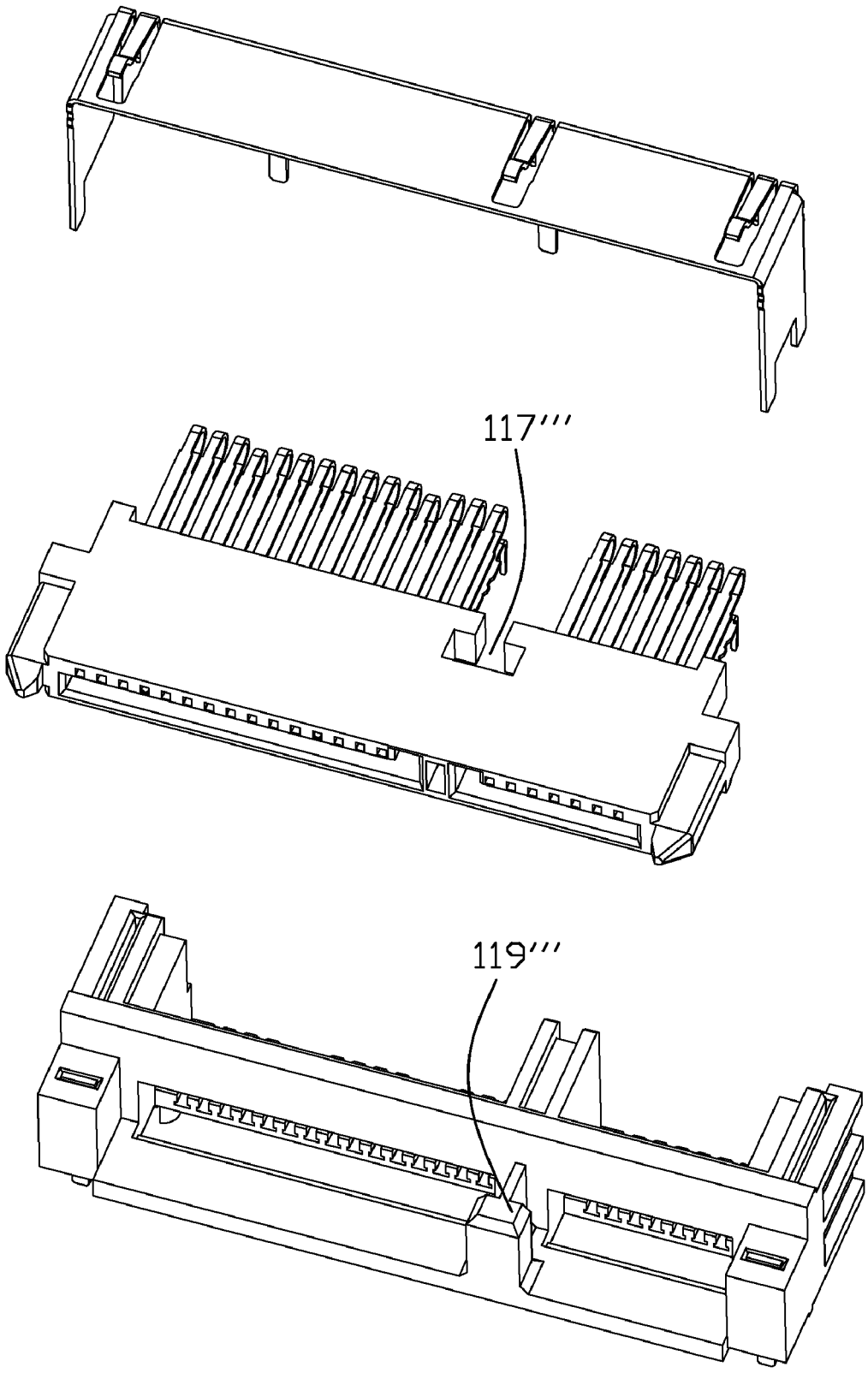
FIG. 15 is an exploded, perspective view of the electrical connector assembly of FIG. 14.

Referring to FIGS. 14 to 15, a floatable electrical connector assembly according to a fourth embodiment of the present invention is the same to the floatable electrical connector assembly of the third embodiment except that the receiving slot 117'" has a boundary which has a small laterally opens to an exterior in order to save material, and the mating bar 119'" in cooperation with the receiving slot 117'" so as to allow the movable housing stably movable relative to the fixed housing in the up-to-down direction.

While the present invention has been described with reference to preferred embodiments, the description of the invention is illustrative and is not to be construed as limiting the invention. Various of modifications to the present invention can be made to preferred embodiments by those skilled in the art without departing from the true spirit and scope of the invention as defined by the appended claims.

What is claimed is:

1. A floatable electrical connector assembly, comprising:

a fixed housing made of an insulative material, the fixed housing defining a front receiving frame, the receiving frame having an edge section;

a movable housing, made of an insulative material, discretely and movably attached to the fixed housing in an up-to-down direction and adapted to rest on said edge section of the receiving frame, the movable housing defining an interior mating face and a back wall;

a plurality of contact terminals assembled to the movable housing, each of the contact terminals having an engaging section exposed on said mating face, a solder tail exposed out of said back wall, and an S-shaped flexible connecting section extending horizontal from said engaging section at one end and extending vertical from said solder tail at the other end; and wherein one of the movable housing and the fixed housing defines a mating bar adjacent said back wall, and the other one of the movable housing and the fixed housing has a receiving slot defining an enclosed boundary for receiving the mating bar so as to allow the movable housing to be movable relative to the fixed housing in said up-to-down direction through cooperation of the mating bar and the receiving slot;

the movable housing has an outer frame border in cooperation with an inner frame boarder of said receiving frame so as to permit the movable housing to be slide within the receiving frame of the fixed housing in a predetermined width in the back-to-forth direction and movable relative to the fixed housing in a predetermined height in the up-to-down direction.

2. The floatable electrical connector assembly as claimed in claim 1, wherein the movable housing has a mating cavity and a plurality of terminal receiving passageways in communication with the mating cavity.

3. The floatable electrical connector assembly as claimed in claim 1, wherein the movable housing having said receiving slot adjacent said back wall, the movable housing divided into a long section and a short section by a partition wall, said receiving slot essentially aligned with said partition wall.

4. The floatable electrical connector assembly as claimed in claim 3, wherein said receiving frame of the fixed housing is defined by a pair of sidewalls and a bottom wall extending fully between said pair of sidewalls and with no top wall upon said receiving frame, said mating bar extending from said bottom wall of the receiving frame.

5. The floatable electrical connector assembly as claimed in claim 1, wherein the fixed housing has a front face and a top face proximate to each other, said receiving slot on said top face, said receiving frame on a lower section of said front face, said receiving slot in communication with said receiving frame on said lower section of said front face but not on an upper section of said front face.

6. The floatable electrical connector assembly as claimed in claim 5, wherein the fixed housing has three of said receiving slots each having an enclosed boundary.

7. The floatable electrical connector assembly as claimed in claim 5, wherein the receiving slot has a boundary opening to an exterior.

8. The floatable electrical connector assembly as claimed in claim 5, wherein the movable housing has a pair of positioning posts on opposite outmost sides, each post defining an outmost edge and an inner edge on a corresponding outmost side of the movable housing, said mating bar extending between said opposite inner edges of said pair of positioning posts.

9. The floatable electrical connector assembly as claimed in claim 5, wherein the receiving frame has a height defined by an upper edge and a bottom edge of the receiving frame, said height sized to permit the movable housing movable in said up-to-down direction relative to the fixed housing.

10. A floatable electrical connector assembly, comprising:

an insulative fixed housing having a front receiving frame, the receiving frame defined by a pair of sidewalls and a bottom wall extending fully between the pair of sidewalls;

an insulative movable housing discretely and movably attached to the fixed housing in an up-to-down direction and adapted to rest on said edge section of the receiving frame, the movable housing defining an interior mating face and a back wall;

a plurality of contact terminals assembled to the movable housing, each of the contact terminals having an engaging section exposed on said mating face, a solder tail exposed out of said back wall, and an S-shaped flexible extending horizontal from said engaging section at one end and extending vertical from said solder tail at the other end; and wherein the fixed housing has a mating bar extending from the bottom wall of the receiving frame, and the movable housing has a receiving slot for receiving the mating bar so as to allow the movable housing to be movable relative to the fixed housing in said up-to-down direction through cooperation of the mating bar and the receiving slot;

the movable housing has an outer frame border in cooperation with an inner frame boarder of said receiving frame so as to permit the movable housing to be slide within the receiving frame of the fixed housing in a predetermined width in the back-to-forth direction and movable relative to the fixed housing in a predetermined height in the up-to-down direction.

11. The floatable electrical connector assembly as claimed in claim 10, wherein the receiving slot has an enclosed boundary.

12. The floatable electrical connector as claimed in claim 10, wherein the receiving slot has a boundary opening to an exterior.

13. The floatable electrical connector assembly as claimed in claim 10, wherein the movable housing has a mating cavity and a plurality of terminal receiving passageways in communication with the mating cavity.

14. The floatable electrical connector assembly as claimed in claim 10, wherein the movable housing is divided into a long section and a short section by a partition wall.

15. A floatable electrical connector assembly comprising:

a fixed rear insulative housing defining a plurality of upward slots;

a moveable front insulative housing defining a mating port;

a plurality of contacts assembled to the movable housing, each of the contacts having an engaging section exposed on said mating face, a solder tail exposed out of said back wall, and an S-shaped flexible connecting section extending horizontal from said engaging section at one end and extending vertical from said solder tail at the other end to compensate relative movement between the front housing and the rear housing in both vertical and transverse directions which are perpendicular to each other; and the movable front housing has an outer frame border in cooperation with an inner frame boarder of a receiving frame of the fixed rear housing so as to permit the movable front housing to be slide within the receiving frame of the fixed rear housing in a predetermined width in the back-to-forth direction and movable relative to the fixed housing in a predetermined height in the up-to-down direction;

inter-engagement devices formed on both said front housing and said rear housing for allowing limited relative movement between the front housing and the rear housing in both said vertical direction and said transverse direction while essentially without a front-to-back direction perpendicular to both said vertical direction and said transverse direction.

16. The floatable electrical connector assembly as claimed in claim 15, wherein said interengagement devices include a groove and a protrusion loosely complementary with each other.

17. The floatable electrical connector assembly as claimed in claim 15, wherein at least one of said front housing and said rear housing defines a cutout opposite to said interengagement devices so as to allow said front housing and said rear housing to be assembled with each other in the vertical direction and have said interengagement device coupled to each other.

18. The floatable electrical connector assembly as claimed in claim 17, wherein said cutout defines a narrow opening so as to restrain the relative movement between the front housing and the rear housing in said vertical direction without risks of disengagement from each other.

19. The floatable electrical connector assembly as claimed in claim 15, wherein said interengagement devices are formed on upper portions of both said front housing and said rear housing.

* * * * *